United States Patent [19]

Dougherty

[11] 4,255,904

[45] Mar. 17, 1981

[54] UNIVERSAL POSITIONING SUPPORT FOR GRINDER WHEELS

[76] Inventor: William E. Dougherty, 1681 Oxford, Grosse Pointe Woods, Mich. 48236

[21] Appl. No.: 96,641

[22] Filed: Nov. 23, 1979

[51] Int. Cl.[3] ..... B24B 7/02

[52] U.S. Cl. ..... 51/35; 51/166 R; 51/99

[58] Field of Search ..... 51/166 R, 166 TS, 166 MH, 51/35, 32, 47, 99, 34 D

[56] References Cited

U.S. PATENT DOCUMENTS 2,704,912 3/1955 Soderlund ..... 51/166 R

*Primary Examiner*—Othell M. Simpson
*Assistant Examiner*—Roscoe V. Parker
*Attorney, Agent, or Firm*—Cullen, Sloman, Cantor, Grauer, Scott & Rutherford

[57] ABSTRACT

An apparatus for universally supporting and positioning a rotating grinder wheel comprising a support base carrying a cage which rotates about a horizontal axis, and with a horizontally reciprocating frame mounted within the cage for rotation with the cage and reciprocating forwardly and rearwardly relative to the cage. A lever has one end universally pivotally connected to the frame, with the opposite end of the lever extending forwardly of the frame and carrying the rotating grinding wheel. A powered vertical guide means connected to the frame raises and lowers a separately powered horizontally movable guide means, which in turn is connected to the lever free end. Thus, the wheel is universally adjusted by rotating the cage, moving the frame forwardly or rearwardly within the cage, and swinging the free end of the lever arm upwardly and sideways.

11 Claims, 4 Drawing Figures

UNIVERSAL POSITIONING SUPPORT FOR GRINDER WHEELS

BACKGROUND OF INVENTION

In the foundry casting industry, it is common to clean castings with a manually operated heavy-duty grinder wheel. A relatively large casting may have a number of metal portions, such as flashings, sprue portions, and other rough protuberances which must be removed. Typically, manually operating grinding wheels are used. These wheels are either manually carried or supported by other means and are manually guided and moved. Other industrial areas also may utilize such types of manually operated grinding wheels.

In the conventional manually operated grinding wheels, the operator is subjected to considerable vibrations, heavy loads and other deleterious forces on his body. Hence, it is desirable to have available a heavy-duty grinding wheel which can be remotely operated, rather than operator guided or supported, but which, nevertheless, can be universally movable in the same manner as a manually operated grinding wheel. That is, to be useful for the above purposes, the grinding wheel must be mounted on a support which can be universally moved, i.e., three dimensionally, so as to position the grinding wheel relative to a stationary work-piece in virtually unlimited directional manners.

Although various types of automatic or controllable machine tools, including grinding equipment, have been available, for the purposes of universal movement or control of the grinding wheel, prior equipment has been relatively expensive and complicated. Moreover, such type tools and equipment have not been adapted for foundry snag grinding applications. Thus, the invention herein is concerned with providing a relatively simple, easily operated and maintained, simple to control, support equipment for a grinding wheel which permits movement of and arrangement of the wheel in operative position in three dimensions.

SUMMARY OF INVENTION

The invention herein contemplates a universal or three dimensional movable support mechanism for positioning and holding a grinding wheel or a similar type of tool in operable locations, similar to that otherwise obtainable by a manual operation. The mechanism may be formed to arcuately move the grinding wheel. Alternatively, it may be formed to move the wheel rectilinearly. In either case, the apparatus contemplates utilizing a cage which is rotatable about a horizontal axis and which is mounted upon a base that is movable upon a floor. A horizontally reciprocating frame, which is movable in the axial direction of the cage, is mounted within the cage. The frame itself carries a guide mechanism for upwardly and downwardly guiding movement. A horizontal guide mechanism cooperates with the vertical guide mechanism to provide a horizontal guide movement as well.

The mechanism for arcuate movement of the wheel includes an elongated lever, one end of which is pivotally connected to the horizontally reciprocating frame. The other end of the lever carries the grinding wheel or the like tool which is power driven by a motor. Between its ends, this lever is connected to the horizontal guide mechanism for swinging the lever in a horizontal arc. The horizontal guide mechanism is connected to and arcuately moved by the upwardly and downwardly guide mechanism so as to move the lever in a vertically arranged arc. Consequently, by moving each of the major elements in its own manner, the overall effect is a universal movement and positioning of the grinding wheel without manual guidance.

The contemplated apparatus for moving the grinding wheel rectilinearly is essentially the same as the arcuately moving apparatus, except that the lever is omitted and the wheel is directly mounted upon the upward and downward guide mechanism which moves along a straight path. The horizontal guide mechanism likewise is formed for straight path movement.

To summarize, the apparatus contemplates rotating, axially moving, vertically moving and horizontally moving a grinding wheel support so as to appropriately position the wheel as needed.

An object of this invention is to provide the universally movable grinding wheel apparatus in a simplified, inexpensive construction which is generally uneffected by the environment in which it will be used, such as in a dusty, dirty grinding operation. The apparatus may be used by a remotely located operator who can be protected from the atmosphere and operate simple controls which cause each of the major components of the apparatus to individually operate so that, in combinatin, pre-determined complex movements of the grinding wheel are provided.

A further object of this invention is to provide a simplified machine which can be easily maintained and repaired and can be operated by an operator with minimal skills and training to reproduce the relatively complex movements which can be manually produced by a manually operated grinding wheel.

These and other objects and advantages of this invention will become apparent upon reading the following description, of which the attached drawings form a part.

DETAILED DESCRIPTION

Figure 1:
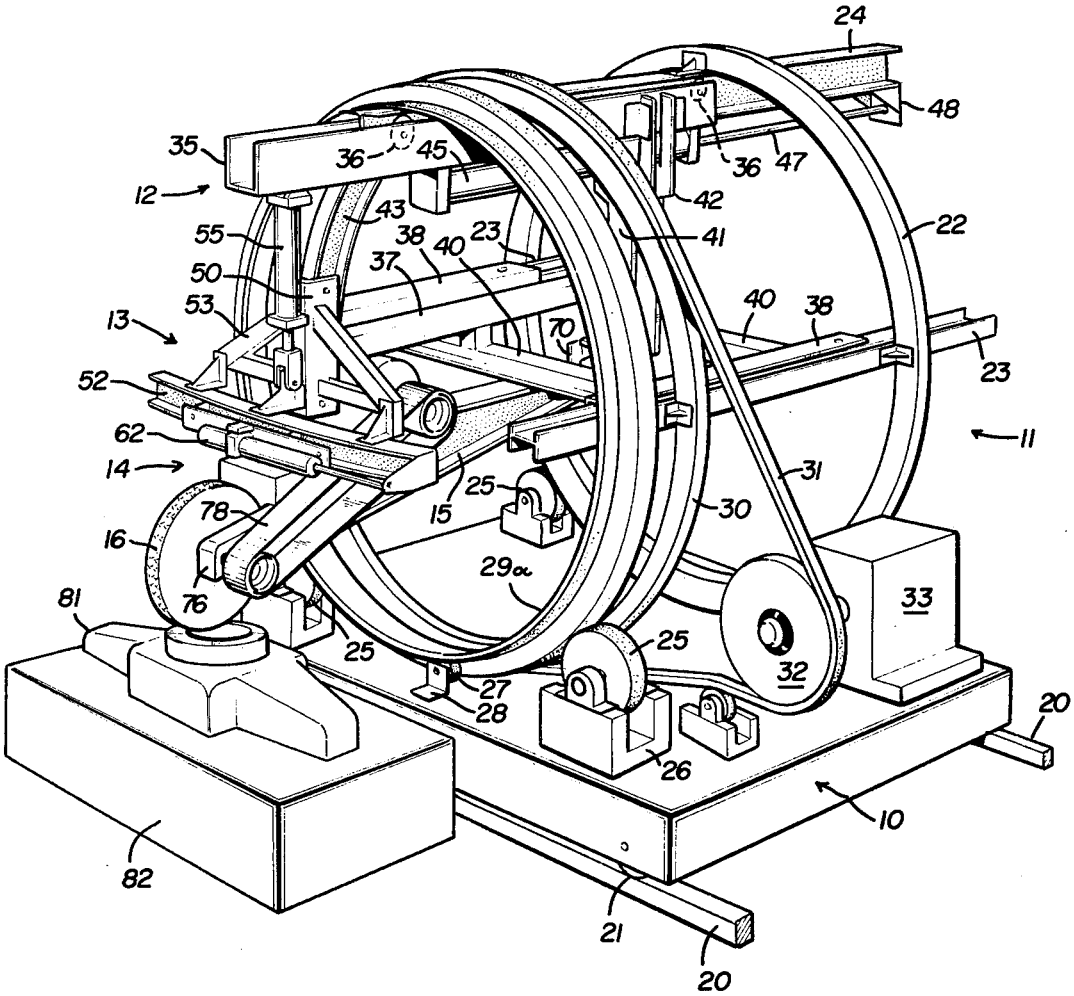
FIG. 1 is a perspective view of the apparatus herein.
Figure 2:
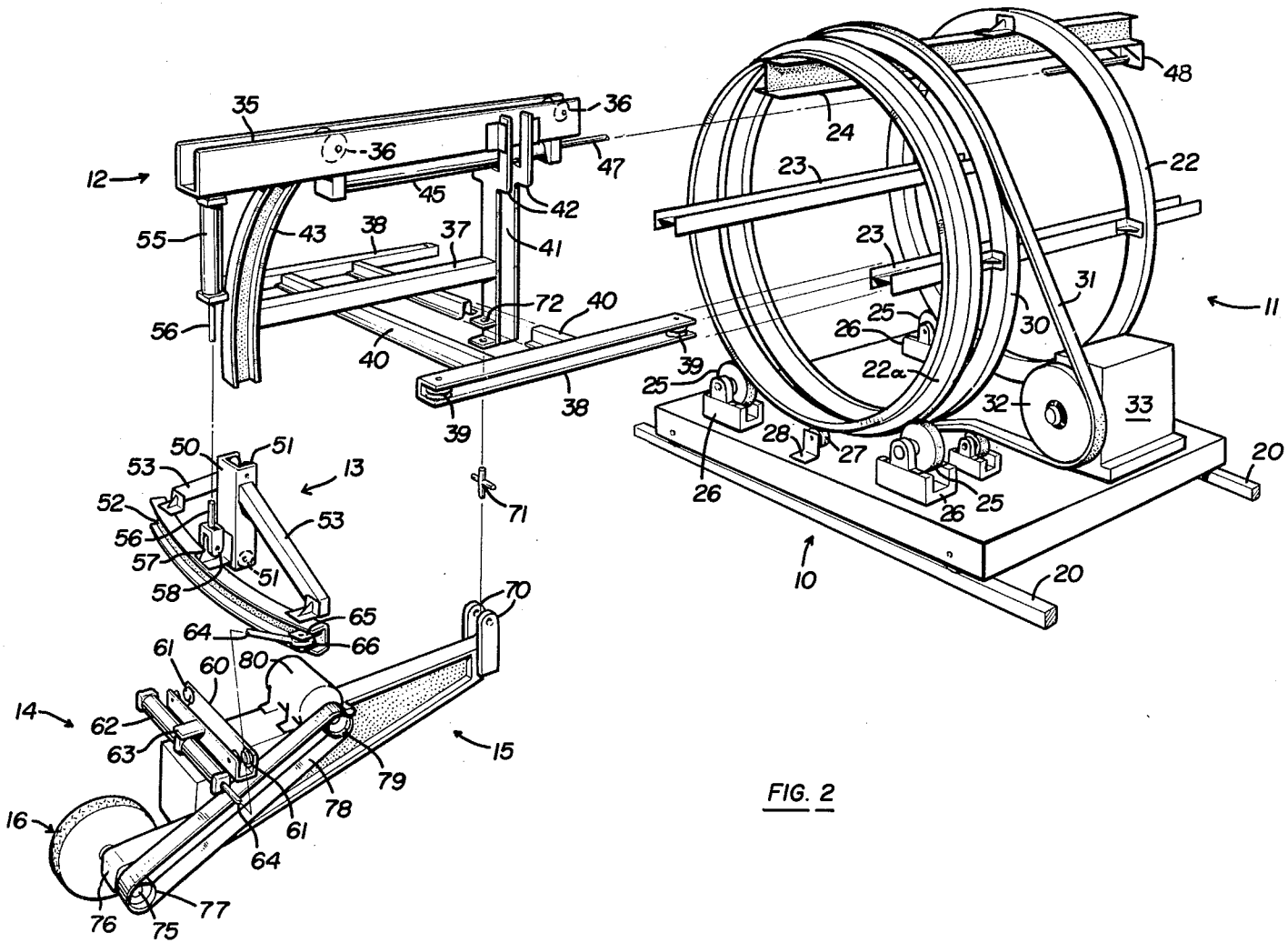
FIG. 2 is a perspective view showing the major components in disassembled relationship.

The apparatus is formed of a number of major components which interengage to produce complex movements and positionings of a grinding wheel or the like type of wheeled tool. Referring to FIGS. 1 and 2, the apparatus generally comprises, as its major components, a base 10 which carries a rotatable cage 11 within which a horizontally reciprocating frame 12 is mounted. A vertical guide mechanism 13 is mounted on one end of the frame and interengages with a horizontal guide mechanism 14 which is secured to one end of an elongated lever or arm 15 that carries the grinding wheel 16. The opposite end of that lever is connected, through a universal type of pivot, to the horizontal reciprocating frame 12.

Operation of the major components produces a complex motion on the part of the grinding wheel, which is made of up the horizontal movement of the base, rotational movement of the cage, endwise horizontal movement of the frame and up and down movement of the vertical guide mechanism coordinating with horizontal movement of the horizontal guide mechanism, all of which tends to rotate, pivot and swing the arm carrying the grinding wheel into pre-determined or pre-selected positions.

The base 10 of the apparatus is in the form of a horizontal bed or table which is supported upon rails 20 laid upon the ground in a shop. Rollers 21 support the base or bed upon the rails so that the base may be moved along the rails to pre-determined locations.

The cage 11, which is supported upon the base or bed for rotational movement about its own axis, comprises a pair of spaced apart, large diameter cage rings 22 and 22*a*. These rings may be formed of elongated metal strips which are bent into ring shape, with their opposing ends welded together. Preferably, at least one if not both, of the ring forming strips is an I-beam. The two rings are arranged in the vertical plane, that is, horizontally axised. The rings are secured together by side beams 23, that are welded or bolted to the rings. Preferably, the side beams are also formed of I-beam material. Other bracing members also may be used to rigidify the cage, as necessary.

In addition, a top beam 24, preferably of an I-beam configuration, is fastened, as by welding or bolting, to the upper portions of the rings 22 and 22*a*. Thus, the rings are interconnected by the side and top beams 23 and 24 to form the cage.

The rings are supported upon horizontally axised support rollers 25 which are rotatably carried upon pads or brackets 26 fastened to the upper surface of the base 10. Consequently, the cage may rotate about its own horizontal axis. To hold the rings against dislodgment from the base, hold-down rollers 27, secured to brackets 28 fastened to the upper surface of the base 10, engages within the channels defined by the I-beam construction of the ring 22*a*. Thus, the hold-down rollers prevent the cage from moving forwardly or rearwardly or upwardly relative to its horizontal axis. Such rollers may be arranged at the opposite sides of each of the rings, that is, a pair of rollers may be used for each of the rings.

A power driven ring or pulley 30 is also secured to the side and top beams 23 and 24 for being driven by a belt or chain 31 which wraps around a drive pulley 32 driven by a suitable electric or hydraulic motor 33.

The horizontally reciprocating frame 12 comprises a horizontally arranged, elongated, upper channel 35 within which are mounted opposed pairs of rollers 36 that engage the lower flanges of the top beam 24 of the cage. That is, the top beam fits within the upper channel 35 and the rollers engage the flanges on opposite sides of the web of the I-beam.

Beneath the upper channel is a parallel spine beam 37. Spaced a distance from the spine beam, on opposite sides thereof, are outrigger or side channels 38, each arranged to receive one of the cage side beams 23. Pairs of rollers 39 mounted within the outrigger or side channels engage the flanges of the side beams on opposite sides of their respective webs. These outrigger or side channels are connected by transverse members or beams 40 to the spine beam 37.

The frame includes a rear vertical post 41 whose upper end is bifurcated to provide a pair of spaced apart legs 42 that are fastened, as by welding or bolting to the upper channel 35.

A forward, curved vertical post 43 is connected at its upper end to the base of the upper channel 35 and at a distance above its lower end, to the spine beam 37. The curvature of the vertical beam is a segment of a circle, preferably.

An elongated, hydraulic cylinder 45 is mounted on the base of the upper channel 35. Its piston rod 46 extends rearwardly and is connected to a bracket 47 secured to the rear end of the cage top beam 24. Thus, operation of the hydraulic cylinder, which is conventional in its construction and operation, causes the piston to move. This causes reciprocation of the piston rod 46 which in turn causes the frame 12 to reciprocate within the cage 11.

The vertical guide mechanism 13 comprises a vertically arranged channel 50 which receives the curved vertical post 43 of the frame 12. Pairs of opposed rollers 51 rotatably mounted within the vertical channel 50 engage the opposite sides of the web and the flanges of the vertical post 43 so that the vertical channel may move upwardly and downwardly along the curvature of the post. A horizontally curved I-beam 52 is secured at its middle to the bottom of the vertical channel 50 and is rigidly connected thereto by means of appropriate braces 53. A vertically arranged hydraulic cylinder 55 is secured to the forward end of the upper channel 35. Its piston rod 56 extends downwardly and is secured through a pivot connection 57 in a bracket 58 to the horizontal curved beam 52. Thus, actuation of the hydraulic cylinder 55 causes the piston rod 56 to move upwardly and downwardly. Consequently, the vertical channel 50 moves upwardly and downwardly along the curve of the post 43.

The horizontal guide mechanism 14 includes a horizontally arranged channel 60 which receives the bottom edge of the horizontal curved beam 52. Pairs of rollers 61 mounted within the horizontal channel 60 engage the flanges, on opposite sides of the web, of the curved beam 52.

A horizontally arranged hydraulic cylinder 62 is fastened by a bracket 63 to the channel 60. Its piston rod 64 extends horizontally to a pivot 65 on a bracket 66 which is fastened to one end of the curved beam 52. Therefore, actuation of the hydraulic cylinder causes the horizontal channel 60 to move horizontally, along the curve of the beam 52. Preferably, the curve or arc is a segment of a circle.

The horizontal channel 60 is secured, at its base, upon the grinding wheel carrying lever 15. Thus, endwise movement of the channel 60 swings the lever.

The lever 15 has vertical universal joint brackets 70 fastened, as by welding, upon its rear end. An X-shaped or T-shaped universal joint connector 71 connects the brackets 70 to a horizontally arranged universal joint bracket 72 formed on the lower end of the rear vertical post 41 of the horizontally reciprocating frame.

The grinding wheel 16 is carried upon a grinding wheel shaft 75 which is journalled through bearings mounted in a support extension or arm 76 formed on and extending from the free end of the lever. A pulley 77 mounted upon the grinding wheel shaft is engaged by a belt 78 which in turn is driven by a motor drive pulley 79 mounted upon the drive shaft of a suitable motor 80. Instead of a circular grinding wheel, other comparable tools may be used. Alternatively, an abrasive belt may be used, for example, by locating a pulley upon the arm above the wheel shaft and a pulley on the wheel shaft itself, which pulleys support a conventional, endless abrasive coated belt which functions like the grinding wheel.

The operator of the apparatus is provided with suitable controls which actuate the grinder motor 80, the cage motor 33, and the hydraulic cylinders 45, 55, and 62. Conventional electric and hydraulic controls may be used with conventional pressurized fluid sources connected to the system. These are not illustrated since they form no part of this invention. However, the operator can be remotely located from the apparatus, at a panelboard containing the operating controls and he can observe the location of the grinding wheel relative to a metal casting 81 or the like which is fastened to a support 82 or to a jig or fixture. By appropriately actuating the hydraulic cylinders and the motors as required, the operator can position the grinding wheel in three dimensional movements, as required, to contact and operate upon the work-piece.

To summarize the operation, the bed or table of the apparatus is moved along its ground rails 20 for positioning. Thereafter, operation of the motor 33 rotates the drive pulley 32, the drive belt or chain 31, and the driven pulley or ring 30 to rotate the cage as required. The motor 33 is a reversible type of motor which is controllable for limited rotational movement so that the cage may be appropriately rotated small angles or large angles as decided upon by the operator.

The horizontal frame may be moved forwardly or rearwardly, along the axis of rotation of the cage, by actuating the hydraulic cylinder 45 to cause the piston 46 to move in a horizontal direction and thereby, due to its reaction against the bracket 47 attached to the rear of the cage upper beam, causes the frame to move horizontally.

Actuation of the hydraulic cylinder 55, causes the vertical guide mechanism to move upwardly or downwardly along the curved beam 43. Likewise, actuation of the hydraulic cylinder 62, causes the horizontal guide mechanism to move along a horizontal arc, that is, along the curved beam 52. These individual movements, together provide the complex movement needed for positioning the grinding wheel as needed.

Figure 3:
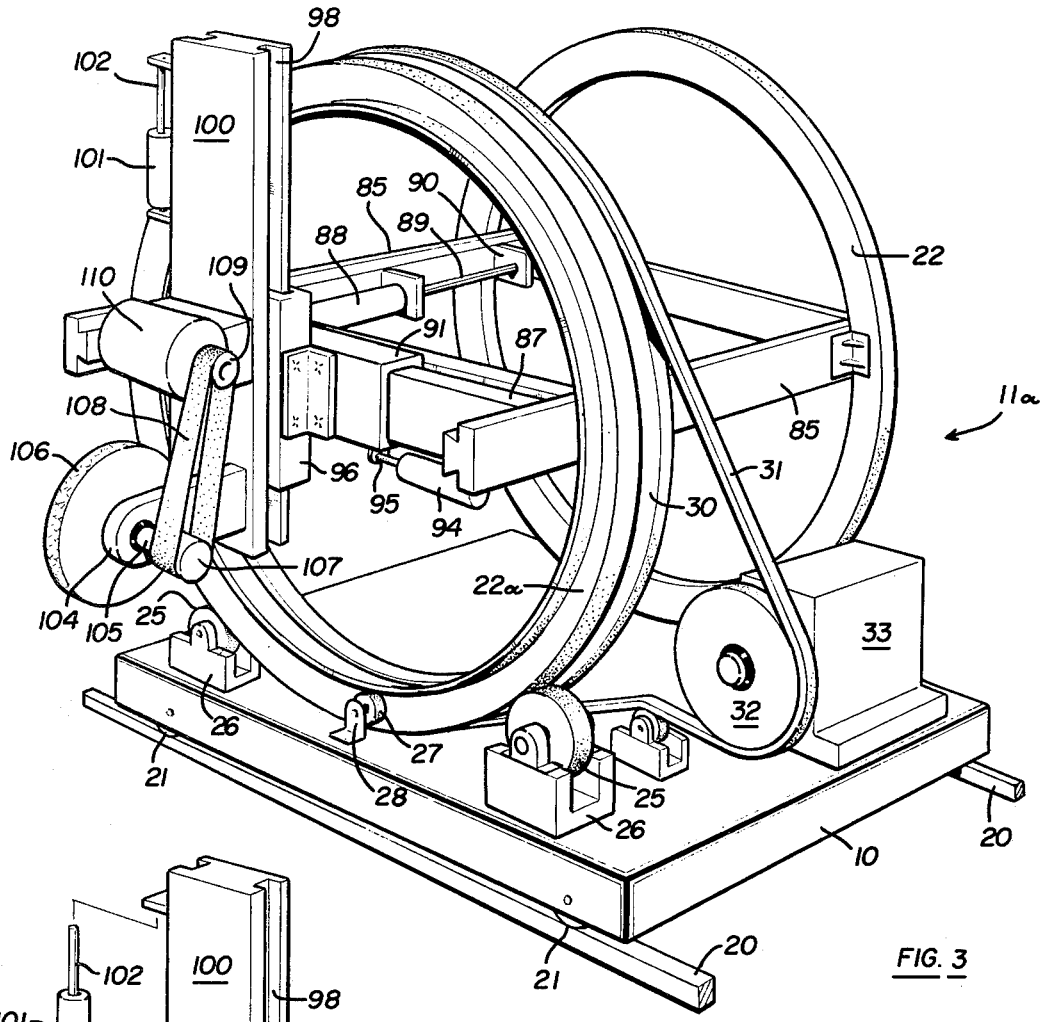
FIG. 3 is a perspective view of the modification which produces rectilinear movement.
Figure 4:
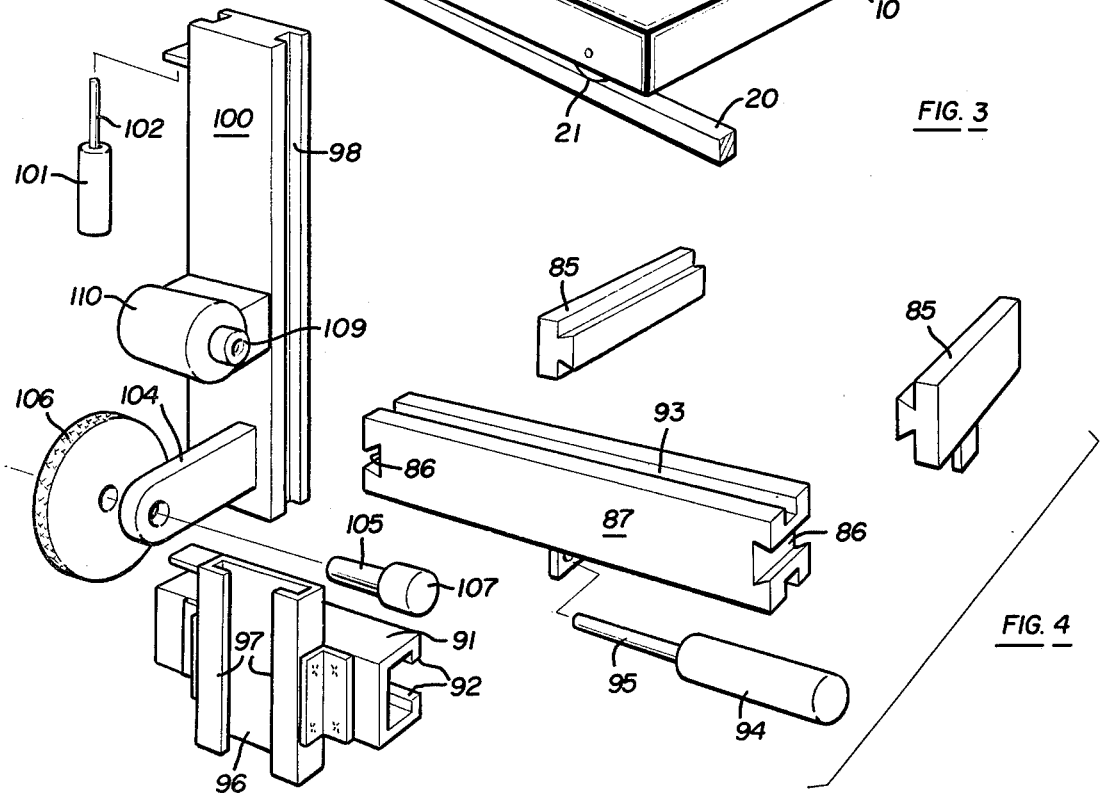
FIG. 4 is a perspective view of some of the components of the modification illustrated in FIG. 3.

FIGS. 3 and 4 schematically illustrate a modification which produces rectilinear motion, i.e., directly horizontal and vertical components of movement, of the grinding wheel in addition to the rotational movement of the cage and the forward and rearward, generally horizontal, movement of the frame mounted within the cage.

The cage 11*a* is constructed essentially the same as, and is rotatably supported the same as, the cage 11 illustrated in FIGS. 1 and 2. However, the cage side beams 85 are formed in a tongue-like dove-tail cross-section for slidably fitting within correspondingly shaped guide grooves 86 formed in the opposite ends of the frame forming beam 87. Alternative interconnections may be provided between the beam 87 and the beams 85.

Hydraulic cylinders 88 are secured to the beam 87, near its opposite ends. Piston rods 89 extend from the cylinders 88 and connect to brackets 90 mounted upon the cage side beams 85. Thus, actuation of the cylinders 88 results in movement of their respective pistons (not shown) to thereby advance or retract their piston rods relative to the cylinders to produce forward and rearward horizontally aligned movement of the frame beam 87.

A channel shaped slider 91 fits over the frame beam 87. Inwardly directed flanges 92 formed on the slider are arranged within upper and lower longitudinally extending grooves 93 formed in the frame beam 87. The slider 91 is endwise movable, i.e., along the length of the beam 87, by means of a hydraulic cylinder 94 which is mounted on the beam 87. The piston rod 95 of the cylinder 94, is connected to the beam 87. Hence, actuation of the cylinder for retraction and extension of the piston rod 95 moves the slider along a straight line path.

A vertically arranged channel 96 is secured to slider 91 for movement therewith. Such channel 96 has inwardly extending flanges 97 which slidably engage within vertically elongated channels 98 formed in the opposite side faces of a vertical post 100. Actuation of an hydraulic cylinder 101, which is secured to the post, retracts or extends its piston rod 102, which is secured to the channel 96, to thereby move the post upwardly and downwardly.

An arm 104, connected to the post 100, carries a grinding wheel shaft 105 upon which the grinding wheel 106 is mounted. A pulley 107 on shaft 105 is driven by a belt 108 from a drive pulley 109 mounted upon the drive shaft of a suitable motor 110. The motor is mounted upon the post 100.

In operation, the cage 11*a* may be rotated about a horizontal axis, as described above. The frame beam 87 is horizontally movable by actuating its hydraulic cylinders 88. The grinding wheel 106 is movable upwardly and downwardly by actuating the post moving cylinder 101, and is moved from side to side by actuating the slider moving cylinder 94.

As can be seen, by means of appropriately conventional controls, the grinding wheel can be positioned as needed by the machine operator.

Having fully described an operative embodiment of this invention, I now claim:

1. An apparatus for universally positioning and supporting a rotating type tool, such as a grinding wheel and the like, comprising:

a horizontally arranged support base;

a rotatable cage supported upon said support base for rotation around a horizontal central axis, with said cage including at least one large ring-shaped member arranged in a fixed vertical plane for rotation about its own horizontal central axis;

and power means for rotating said ring-shaped member and the cage for a predetermined limited angle or rotation;

a horizontally reciprocal frame, having a forward end and a rearward end, arranged within said cage and surrounded by said ring-shaped member;

means mounting said frame upon said ring-shaped member for guided movement of the frame forwardly and rearwardly along the direction of the ring axis;

powered means for moving said frame pre-determined distances forwardly and rearwardly relative to said ring-shaped member;

an elongated arm located forwardly of the frame and means connecting the rearward end of the arm to the frame for horizontal and vertical movement relative to the frame;

the opposite, free end, of the arm extending forwardly of the frame, and a rotatable tool, such as a grinding wheel and the like, being mounted upon said lever free end upon a fixed axis of rotation;

said means for moving the arm including a guide means secured to the forward end of the frame for generally horizontally directed movement, and a vertical guide member connected to said guide means for upwards and downwards movement relative to said frame;

powered means for moving said vertical guide member up and down and powered means for moving said horizontally moving guide means member pre-determined distances along said frame;

wherein movement of said horizontally moving guide means moves the free end of the arm in a generally horizontal direction, with movement of said vertical guide member means causing the free end of the lever to move up and down, and forward and rearward movement of the frame causes the arm, including its free end to move forwardly and rearwardly, with rotation of the ring-like member rotating the arm relative to the axis of rotation of the cage, for thereby universally positioning the tool blade mounted upon the arm free end.

2. A construction as defined in claim 1, and said frame comprising a beam arranged transversely of the cage rings; and said horizontally moving guide means including a slider member mounted upon said beam for sliding longitudinally of said beam, i.e., transversely of the cage ring axis;

said vertical guide member comprising a post member which is arranged generally perpendicularly to and slidably connected to said slider member for relative transverse movement between the slider and post member, and said arm being mounted upon said post, for thereby connecting the arm to said frame.

3. An apparatus for universally positioning and supporting a rotating type tool, such as a grinding wheel and the like, comprising:

a horizontally arranged support base;

a rotatable cage supported upon said support base for rotation around a horizontal central axis, with said cage including at least one large ring-shaped member arranged in a fixed vertical plane for rotation about its own horizontal central axis;

and power means for rotating said ring-shaped member and the cage for a predetermined limited angle or rotation;

a horizontally reciprocal frame, having a forward end and a rearward end, arranged within said cage and surrounded by said ring-shaped member;

means mounting said frame upon said ring-shaped member for guided movement of the frame forwardly and rearwardly along the direction of the ring axis;

powered means for moving said frame pre-determined distances forwardly and rearwardly relative to said ring-shaped member;

an elongated lever arm normally located beneath the frame and having a rearward end pivotally connected to the frame, with the pivot connection being formed for pivoting movement of the lever horizontally and vertically relative to the frame;

the opposite, free end, of the lever extending forwardly of the frame, and a rotatable tool, such as a grinding wheel and the like, being mounted upon said lever free end upon a fixed axis of rotation;

an upright guide rail secured to the forward end of the frame, and a vertical guide member mounted upon said guide rail for upwards and downwards movement upon said guide rail;

a normally horizontally arranged, elongated guide rail secured to said vertical guide member for vertical movement therewith;

powered means for moving said vertical guide member up and down along said upright guide rail, so as to position said horizontally arranged guide rail in pre-determined horizontal positions transversely of the axis of rotation of said ring-like member;

a horizontally arranged guide member, interengaged with said horizontal guide rail for movement along the length of same, and secured to said lever near the free end thereof;

and powered means for moving said horizontally arranged guide member pre-determined distances along said guide rail;

wherein movement of said horizontal guide member moves the free end of the lever in a generally horizontal direction, with movement of said vertical guide member means causing the horizontal guide rail and consequently, said horizontal guide means, and therefore, the free end of the lever to move up and down;

and movement of the frame causes the entire lever, including its free end to move forwardly and rearwardly, with rotation of the ring-like member rotating the entire lever relative to the axis of rotation of the cage, for thereby universally positioning the tool blade mounted upon the lever free end.

4. An apparatus as defined in claim 3, and said cage comprising a pair of spaced apart ring-shaped members;

with horizontally arranged rails interconnecting and secured to said ring-shaped members and located on the inner peripheries thereof;

said frame having horizontally arranged channel-shaped in cross-section members aligned with and slidably interconnected with said rails for slidably mounting the frame reltive to the cage.

5. An apparatus as defined in claim 4, and including pairs of spaced apart rollers mounted upon said support base in alignment with the planes of said ring-shaped members;

with said ring-shaped members being rotatably supported upon said rollers with their peripheries engaging and resting upon a pair of said rollers.

6. An apparatus as defined in claim 5, and said power means for rotating said ring-shaped member including a drive ring, connected to said cage, and being a diameter of roughly the same as the ring-shaped member, with a drive belt encircling the drive ring and driven by a motor-driven pulley mounted upon said support base.

7. An apparatus as defined in claim 4, and said cage rails including three rails located 90 degrees apart with two of said rails normally being arranged in a horizontal plane and the third rail being located above the other two;

said frame members being in the form of elongated channels which receive said rails;

said lever arm pivot being formed on a frame member located near the rearward end of the frame and centrally of the horizontal pair of frame channels and extending upwardly to connect with the upper frame channel.

8. An apparatus as defined in claim 7, and said upright guide rail secured to the forward end of the frame being curved along an arc parallel to the arc of movement of the free end of the lever and being arranged in a normally vertical plane.

9. An apparatus as defined in claim 8, and said horizontal guide rail being curved, within a normally horizontal plane, along an arc parallel to the normally horizontal arc of swinging of the free end of the lever.

10. An apparatus as defined in claim 9, and said power means for moving the frame relative to the cage, and said power means for moving the upright guide rail relative to the vertical guide means, and said power means for moving the horizontal guide member relative to the horizontal guide rail, each comprising a separate fluid cylinder containing a movable piston having a piston rod which reciprocates relative to said cylinder upon fluid actuation of said cylinder, with the cyliners each being connected to one of and the pistons each being connected to the other of the two elements to be moved relative to each other, wherein each pair of such elements may be separately moved pre-deterined distances.

11. An apparatus as defined in claim 3, and including a drive motor mounted upon said lever arm and operably connected to the tool blade for rotation thereof for working purposes.

* * * * *